US011319718B2

(12) United States Patent
Tourneur et al.

(10) Patent No.: US 11,319,718 B2
(45) Date of Patent: May 3, 2022

(54) METHOD FOR REINFORCING A CIVIL ENGINEERING STRUCTURE

(71) Applicant: SOLETANCHE FREYSSINET, Rueil Malmaison (FR)

(72) Inventors: Christian Tourneur, Le Mesnil Saint-Denis (FR); Julien Mercier, Vanves (FR); Vanessa Buchin-Roulie, Versailles (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 16/771,633

(22) PCT Filed: Dec. 21, 2017

(86) PCT No.: PCT/FR2017/053793

§ 371 (c)(1),
(2) Date: Jun. 10, 2020

(87) PCT Pub. No.: WO2019/122542

PCT Pub. Date: Jun. 27, 2019

(65) Prior Publication Data

US 2021/0071435 A1 Mar. 11, 2021

(51) Int. Cl.
*E04G 23/02* (2006.01)

(52) U.S. Cl.
CPC .. *E04G 23/0218* (2013.01); *E04G 2023/0251* (2013.01)

(58) Field of Classification Search
CPC ..... E04G 23/0218; E04G 2023/0251; E04G 2023/0262

(Continued)

(56) References Cited

U.S. PATENT DOCUMENTS 5,640,825 A * 6/1997 Ehsani ..... E04G 23/0218 428/408
5,649,398 A * 7/1997 Isley, Jr ..... E04C 5/07 52/309.17

(Continued)

FOREIGN PATENT DOCUMENTS

JP 2002-20509 A 1/2002
JP 2003-2948 A 1/2003

(Continued)

OTHER PUBLICATIONS

Kumar, Narendhara, Anand, Anoop, Ramadas, C., & Joshi, Makarand.; Effects of Nanofillers on Strength of Adhesives for Lap Shear Applications; Dec. 15, 2017, obtained from https://link.springer.com/article/10.1007/s40032-017-0419-1?shared-article-renderer (Year: 2017).*

(Continued)

*Primary Examiner* — Theodore V Adamos
(74) *Attorney, Agent, or Firm* — Dentons US LLP

(57) ABSTRACT

The invention relates to a method for reinforcing a civil engineering structure, comprising the following steps: —coating a surface of the structure with a first layer of resin in a fluid state, having a particle size distribution, termed first particle size distribution, —applying a layer of a dry woven fabric with a weight per unit area greater than or equal to 600 g/m2, termed high-grammage woven fabric, to the coated surface while the resin is still in the fluid state, by exerting on the woven fabric a pressure sufficient to impregnate it with resin, —coating the woven fabric with a second layer of resin, termed closure layer, in a fluid state, having a particle size distribution, termed second particle size distribution, which is less than or equal to the first particle size distribution.

11 Claims, 1 Drawing Sheet

(58) Field of Classification Search
USPC ..... 52/223.1, 231, 222, 291, 293.1, 293.2, 52/293.3, 309.1, 506.01, 506.05, 736.3, 52/738.1, 746.1, 514, 514.5, 7.12
See application file for complete search history.

(56) References Cited

U.S. PATENT DOCUMENTS

| | | | | |
|---|---|---|---|---|
| 6,145,260 | A * | 11/2000 | Morton | E04G 23/0218 52/293.2 |
| 6,418,684 | B1 * | 7/2002 | Morton | E04G 23/0218 52/293.2 |
| 6,938,390 | B2 * | 9/2005 | Maeda | B29C 70/30 156/71 |
| 7,980,033 | B1 * | 7/2011 | Fyfe | E02D 27/42 52/271 |
| 8,479,468 | B1 * | 7/2013 | Abbasi | E04G 23/0218 52/408 |
| 2002/0170651 | A1 * | 11/2002 | Edwards | B29C 70/30 156/94 |
| 2009/0071085 | A1 * | 3/2009 | Wheatley | E04G 23/0218 52/291 |
| 2014/0144095 | A1 * | 5/2014 | Blaszak | D03D 15/593 52/514 |
| 2016/0138285 | A1 * | 5/2016 | Berset | E04C 5/07 52/514.5 |
| 2016/0258173 | A1 * | 9/2016 | Wheatley | E04C 5/07 |

FOREIGN PATENT DOCUMENTS

| | | | |
|---|---|---|---|
| JP | 2008-063758 | A | 3/2008 |
| JP | 2009-515071 | A | 4/2009 |
| WO | 2007054388 | A1 | 5/2007 |

OTHER PUBLICATIONS

Wayback machine capture date for NPL Sika reference dating Nov. 25, 2013, obtained from https://web.archive.org/web/20131125091801/https://gbr.sika.com/dms/getdocument.get/a21d082d-e1f5-3549-937d-6920931d4440/Sika%20CarboDur%20-%20Structural%20Strengthening%20Systems.pdf (last accessed on Jun. 30, 2021) (Year: 2013).*

Sika Corp., SikaLatex R Product Data Sheet, Oct. 2018 (obtained from https://usa.sika.com/content/dam/dms/us01/o/sikalatex_r.pdf) (Year: 2018).*

Sika Corp., SikaWrap Hex 106 G Product Data Sheet, May 5, 2011, (obtained from https://www.norkan.com/forms/sika/sikawrap/pds-cpd-SikaWrapHex106G-us.pdf) (Year: 2011).*

Sika Corp., Sikagard 670W, Division 9—Finishes, Section 09880 Protective Coatings, (earliest available publication on Sep. 30, 2020 obtained from https://web.archive.org/web/20200930104523/https://usa.sika.com/content/dam/dms/us01/a/sc-cpd-Sikagard670W-us.pdf) (Year: 2020).*

Sika Espana: "Refuerzo structural—SikaWrap—Sika Espana", Youtube, Dec. 14, 2011, XP002779238.

Sika: "Sika Carbodur Structural Strengthening Systems", May 31, 2003, XP055460297.

* cited by examiner

METHOD FOR REINFORCING A CIVIL ENGINEERING STRUCTURE

This application is a National Stage Application of International Application No. PCT/FR2017/053793, filed on Dec. 21, 2017, which is hereby incorporated by reference in its entirety for all purposes as if fully set forth herein.

The invention relates to a method for reinforcing a civil engineering structure.

BACKGROUND

A first known method for reinforcing a surface is to bond sheets of steel plate to the concrete of the structure to supplement the reinforced-concrete reinforcements, particularly in tensioned parts of said structure.

It is necessary to hold the sheets in position on the surface using a mechanical means, such as a clamping frame, in order on the one hand to compress a film of adhesive and, on the other hand, support the weight of the plates while the resin cures.

This technique has been widely employed in the construction industry but has been found over time to have the major disadvantage of exposing the reinforcing plates to weathering and of requiring costly periodic maintenance in order to prevent them from corroding.

During the 1990s, the steel plates were replaced by sheets or plies made of carbon fiber composite, which offer the advantages of being insensitive to corrosion, of being lightweight and of having mechanical properties superior to those of the steel sheets used up to that point.

The use of carbon fiber has allowed the development of another reinforcing method that involves coating a surface in a region that is to be reinforced with resin and then applying a strip of dry carbon-fiber fabric to the coated surface, in order to construct the composite on the support itself.

This method has indisputable advantages, such as its ability to reinforce, through the addition of carbon-fiber composites, on surfaces that are not planar, as well as greater lightness of weight and greater ease of handling.

Nevertheless, only small thickness (up to thicknesses of the order of 0.5 mm) and low dry grammage (up to 500 g/m$^2$) fabrics can be impregnated directly as they are being applied to the support, and this means that the method is limited to smaller reinforcement cross-sections (or fiber densities).

It is an object of the invention to at least partially overcome these disadvantages.

SUMMARY

To that end, the subject of the invention proposes a method for reinforcing a civil engineering structure, comprising:

- coating a surface of the structure with a first layer of resin in a fluid state, having a particle size referred to as the first particle size,
- applying a layer of dry fabric with an areal weight greater than or equal to 600 g/m$^2$, referred to as a high grammage fabric, to the coated surface, the resin still being in the fluid state, while applying to the fabric sufficient pressure to impregnate it with resin,
- coating the fabric with a second layer of resin, referred to as sealed resin, in the fluid state and having a particle size referred to as the second particle size, less than or equal to the first particle size, so as to form a composite reinforcement.

The resin, once cured, i.e. hardened, constitutes the matrix of the composite that forms the reinforcement of the structure.

In other words, the resin performs two functions because it is able to bond the composite in place and form the matrix thereof.

Thus, the method according to the present invention, by applying resins with calibrated particle sizes allows the dry fabric to be saturated (sufficiently impregnated) to form a composite, the first resin with which the support is coated being viscous enough to support the self-weight of the fabric, thereby allowing the structure to be reinforced with a larger resistive section (fiber density), while making use of a dry fabric said to have a high grammage (areal density greater than 600 g/m$^2$).

According to another feature of the invention, the resin is in the form of a gel in the fluid state.

According to another feature of the invention, the fabric is made up of fibers having interstices, the first particle size and the second particle size being strictly smaller than the interstices, or even zero (i.e. with no added inert fillers).

According to another feature of the invention, the first particle size (intended for coating the support before laying the dry fabric) is less than or equal to 1 μm and preferably less than or equal to 0.1 μm.

According to another feature of the invention, granular elements of the resin comprise nanoparticles and/or silica.

According to another feature of the invention, the resin has a Brookfield viscosity at 23° C. giving a shear rate of 15 to 25 Pa·s for a rotational speed of 1 s$^{-1}$ and of 3 to 5 Pa·s for a rotational speed of 10 s$^{-1}$.

According to another feature of the invention, the resin contains a thickener.

According to another feature of the invention, the resin has a zero particle size, which means to say has no added inert fillers.

According to another feature of the invention, inert granular elements or fillers are added in a proportion comprised between 2% and 12%, preferably between 5% and 10% by weight.

BRIEF DESCRIPTION OF THE DRAWINGS

Further features and advantages of the invention will become apparent from reading the following description. This description is purely illustrative and is to be read in connection with the attached drawings in which.

DESCRIPTION OF EMBODIMENTS

Structural Reinforcement

Figure 1:
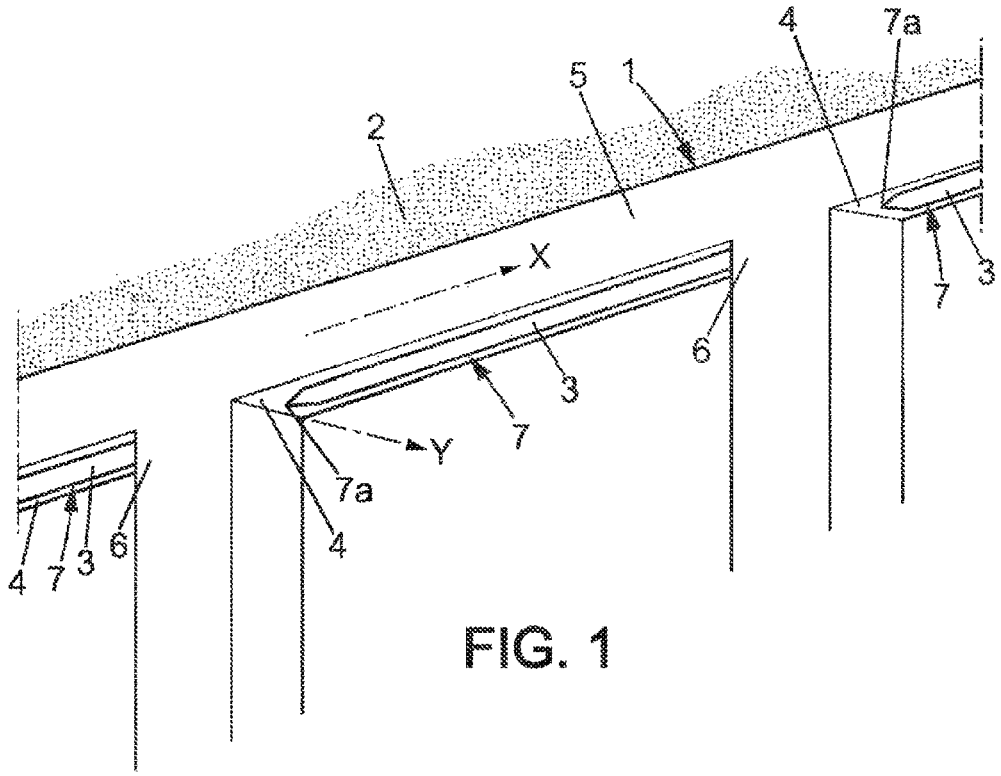
FIG. 1 is a perspective illustration of one exemplary embodiment of the method according to the invention.

FIG. 1 shows one particular embodiment of the method according to the invention, used to reinforce or repair a reinforced concrete beam 1 supporting a floor 2 of a building.

However, this application is of course nonlimiting and the invention can be used to reinforce any civil engineering structure, particularly one made of concrete, metal (notably steel) or wood.

This reinforcement is obtained by bonding a flexible fiber fabric 3 to at least one surface of the civil engineering structure: the structural region that is to be reinforced will generally be a region subjected to tensile load, in this instance the underside 4 of the beam 1, but it could also be possible to reinforce in the same way a region of the civil engineering structure that is subjected to shear loads (these stresses inducing what are referred to as main tensile stresses), for example by bonding a flexible fabric to the sides 5 of the beam 1 considered here, in line with the supports 6 for this beam.

Figure 2:
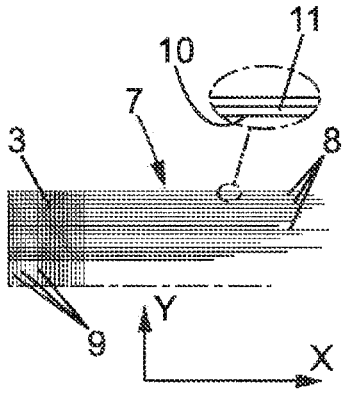
FIG. 2 illustrates a layout of carbon fibers within a fiber fabric strip of the example of FIG. 1.

As can be seen from FIG. 2, the fiber fabric 3 preferably takes the form of a flexible strip 7 extending in a longitudinal direction X and which is generally stored in the form of a roll.

This strip 7 is made up of fibers of which some, referenced 8, extend in the longitudinal direction X, and others, referred to as the weft fibers, referenced 9 (possibly with a different thickness from the fibers 8) extend in a transverse direction Y parallel to the width of the strip 7 (or possibly in an oblique direction).

Each fiber 8, 9 is made up of filaments separated from one another by interstices 10.

For example, the diameter of the filaments is comprised between 5 μm and 7 μm and that of the interstices is of the order of 2 μm.

The fibers are for example made of carbon, glass, aramid or even basalt.

When the strip 7 is applied to a surface adjacent to a region that is to be reinforced which is subjected to tensile load, the longitudinal direction X of this strip is preferably parallel to these tensile loads: thus in the example depicted in the drawings, the strip 7 is positioned parallel to the length of the beam 1.

Reinforcing Method

First of all, the surface 4 of the civil engineering structure that is to be reinforced is cleaned, if necessary sandblasted and degreased, or else this surface may undergo any other mechanical or chemical preparation technique aimed at ensuring the durability of the reinforcement. In particular, a coating referred to as a primer may be applied to this surface as a preliminary.

Next, the surface 4 is coated with a thin film of resin in a fluid state, as will be detailed later on.

The fiber fabric 7 is applied next, dry, to the film of resin still in the fluid state.

The fabric 7 is pressed down, which is to say pressed against the application surface, with enough pressure to even out the thickness of resin between the surface 4 and the fabric, and to impregnate the fabric with the resin.

The pressing-down is performed using, for example, a pressing roller and/or a spreader.

The fabric 7 is then coated with a second layer of resin.

If appropriate, further applications of resin and fabric are performed if it is necessary to use several superposed layers of fabric, possibly using different sizes of fabric.

As a preference, the fabric 7 has a high grammage, namely an areal weight greater than 600 g/m$^2$, the particular advantage of high-grammage fabrics being that they offer a greater thickness (resistant section), for the same surface area, in order to avoid or limit the need to resort to superposing several layers of fabric.

In practice, the superposed layers of reinforcing fabric are, by regulation, assigned a reducing coefficient relating to their mechanical performance.

Resin Application Steps

As already indicated, the application of resin is performed in two steps.

In a first step, the surface 4 is coated with a first layer of resin containing inert granular elements having a particle size referred to as the first particle size.

What is meant by the particle size is the maximum size of the inert fillers present in the resin.

What is meant by a zero particle size is that the resin contains no fillers.

The fabric fiber 7 is then applied, dry, to the film of resin still in the fluid state. The fabric 7 is pressed down so that it is well impregnated with resin.

In a second step, the fabric is then coated with a second layer of resin, referred to as the sealant resin, containing granular elements having a particle size referred to as the second particle size, less than or equal to the first particle size, and possibly zero (without inert fillers).

The resin used is a fluid epoxy system intended for lamination and for coating porous supports such as concrete or wood and suitable for creating or reinforcing composite structures.

This resin is, for example, a two-part epoxy resin combining, on the one hand, a base resin and, on the other hand, a hardener, which are mixed at the time of application.

The base resin has a density of around 1.10 and a viscosity comprised between 1.0 and 1.5 Pa·s at 23° C.

The hardener has a density of around 1.0 and a viscosity comprised between 0.05 and 0.25 Pa·s at 23° C.

The resin/hardener mixture, when it does not contain any thickener, in a dosing ratio of 100/30 by weight, has a viscosity comprised between 0.5 and 1.5 Pa·s at 23° C.

In order to meet the application constraints, it is advantageous to employ a resin that has a thixotropic nature (i.e. that has a viscosity that is higher at rest). This nature is obtained either by adding a rheo-thickening liquid or by adding inert fillers or else by a combination of the two approaches.

More generally, the resin used may be a thermoplastic or thermosetting resin, which may or may not be fire retardant, and may or may not have UV resistance, which has the ability to adhere both to the surface of the civil engineering structure and to the carbon fibers and which is able to plug any cracks in the surface that is to be reinforced 4.

As a preference, the resin is thixotropic when in the fluid state and is solvent-free.

As a preference, the resin is a gel in the fluid state.

Advantageously, use is made of a resin which cures at ambient temperature.

Furthermore, it will be noted that the same resin can be used whatever the material of the civil engineering structure (concrete, metal, wood).

The application of resin with granular elements of two different particle sizes makes it possible both to ensure sufficient viscosity for good adhesion to the support and good holding of the dry fabric (even when being applied to a ceiling) while at the same time having a particle size that is small enough to allow good impregnation of the fabric.

The application of resin with the first particle size, which is higher than the second particle size, makes it possible to obtain the desired viscosity, the granular elements (i.e. the inert fillers) giving it a satisfactory consistency for adhering to the support and supporting the weight of the fabric.

During the pressing-down, the resin migrates into the interstices between the filaments. The resin interpenetrates the interstices of the fabric, despite the presence of the granular elements.

The application to the pressed-down fabric of a sealant layer of resin with the second particle size, which is low or even zero, ensures that the resin is able to penetrate deeply and at least as far as the first layer applied to the support.

Thus, the application of the first layer to the support on the one hand, and of the second layer of resin, referred to as the sealant layer, to the pressed-down fabric, makes it possible to obtain a composite that is correctly saturated (or impregnated) to bond to the support on the one hand and constitute the matrix of the composite on the other.

As already indicated, it is therefore possible to use a dry fabric with a high grammage, namely with an areal weight greater than or equal to 600 g/m$^2$, or even strictly greater than 600 g/m$^2$, and even greater than or equal to 700 g/m$^2$, up to 1500 g/m$^2$.

As a preference, the resin obtained after the mixing of the components (the base resin and the hardener) has a Brookfield viscosity at 23° C. giving a shear rate of 15 to 25 Pa·s for a rotational speed of 1 s$^{-1}$ and of 3 to 5 Pa·s for a rotational speed of 10 s$^{-1}$ as measured by an annular-ducts plate-to-plate Brookfield rheometer.

As already indicated, the first particle size is strictly smaller than the interstices.

Furthermore, the second particle size is smaller than the first, or else zero.

For example, the first particle size is less than or equal to 1 μm, preferably less than or equal to 0.1 μm.

In most cases and particularly in the case of a zero particle size, the resin may contain a thickener such as a liquid additive, having a rheo-thickening nature. The mixing is performed separately for the hardener on the one hand and for the resin on the other, using a high turbulence deflocculating mixer.

In the case of a non-zero particle size, granular elements such as inert fillers are used to thicken the resin (and the hardener). As described previously, mixing is performed separately for the hardener on the one hand and for the resin on the other, using a high-turbulence deflocculation mixer. These mixing operations are performed at the workshop or at the factory, so that only the mixing of the base resin and of the hardener is performed at the application site, using a simple mixer.

The granular elements are very fine particles such as nanoparticles or, for a lower cost, filler elements with a very fine particle size such as silica, for example fumed and hydrophilic silica with a maximum particle size ranging from 0.04 to 0.99 μm.

Advantageously, the inert fillers or granular elements are added in a proportion comprised between 2% and 12%, preferably between 5% and 10% by weight, in the case of the base resin and in the case of the hardener.

What is thus obtained is a resin that is able to remain stuck to the ceiling over significant thicknesses (0.7 to 0.9 mm) without running.

Advantageously, the granular elements have dimensions smaller than 0.06 μm, namely approximately 30 times smaller than the size of the interstices.

With the resin formulated in this way in the form of a gel according to the present invention, the low pressure of manual pressing-down is enough to cause the resin to migrate into the filamentary interstices and makes it possible to obtain a level of saturation of the order of 75% for a 1200 g/m$^2$ fabric.

The invention claimed is:

1. A method for reinforcing a civil engineering structure, the method comprising:

coating a surface of the structure with a first layer of resin in a fluid state, the first layer of resin having a first particle size, with the resin still in the fluid state, applying a layer of dry fabric, having an areal weight greater than or equal to 600 g/m$^2$, to the coated surface, while applying to the dry fabric sufficient pressure to impregnate the dry fabric with resin, coating the fabric with a second layer of resin in the fluid state, the second layer of resin having a second particle size less than the first particle size.

2. The method as claimed in claim 1, wherein the first layer of resin in the fluid state comprises resin in the form of a gel.

3. The method as claimed in claim 1, wherein resin of at least one of the first and second layers of resin contains a thickener.

4. The method as claimed in claim 1, wherein the fabric comprises fibers having interstices, the first particle size and the second particle size being strictly smaller than the interstices.

5. The method as claimed in claim 1, wherein the first particle size is less than or equal to 1 μm.

6. The method as claimed in claim 5, wherein the first particle size is less than or equal to 0.1 μm.

7. The method as claimed in claim 1, wherein at least one of the first and second layers of resin contains granular elements comprising nanoparticles.

8. The method as claimed in claim 1, wherein resin of at least one of the first and second layers of resin has a Brookfield viscosity at 23° C. giving a shear rate of 15 to 25 Pa·s for a rotational speed of 1 s$^{-1}$ and of 3 to 5 Pa·s for a rotational speed of 10 s$^{-1}$.

9. The method as claimed in claim 1, wherein inert granular elements or fillers are added to at least one of the first and second layers of resin in a proportion between 2% and 12% by weight.

10. The method as claimed in claim 9, wherein said proportion is between 5% and 10% by weight.

11. The method as claimed in claim 1, wherein at least one of the first and second layers of resin contains granular elements comprising silica.

* * * * *